US008204754B2

(12) United States Patent
Sehlstedt

(10) Patent No.: US 8,204,754 B2
(45) Date of Patent: Jun. 19, 2012

(54) SYSTEM AND METHOD FOR AN IMPROVED VOICE DETECTOR

(75) Inventor: Martin Sehlstedt, Luleå (SE)

(73) Assignee: Telefonaktiebolaget L M Ericsson (Publ), Stockholm (SE)

( * ) Notice: Subject to any disclaimer, the term of this patent is extended or adjusted under 35 U.S.C. 154(b) by 971 days.

(21) Appl. No.: 12/279,042

(22) PCT Filed: Feb. 9, 2007

(86) PCT No.: PCT/SE2007/000118

§ 371 (c)(1),
(2), (4) Date: Aug. 11, 2008

(87) PCT Pub. No.: WO2007/091956

PCT Pub. Date: Aug. 16, 2007

(65) Prior Publication Data

US 2009/0055173 A1 Feb. 26, 2009

Related U.S. Application Data

(60) Provisional application No. 60/743,276, filed on Feb. 10, 2006.

(51) Int. Cl.
*G10L 19/00* (2006.01)
*G10L 11/06* (2006.01)

(52) U.S. Cl. ..... 704/500; 704/210; 704/215

(58) Field of Classification Search ..... 704/210, 704/248, 253, 215, 500–504
See application file for complete search history.

(56) References Cited

U.S. PATENT DOCUMENTS

| | | | | |
|---|---|---|---|---|
| 5,276,765 | A * | 1/1994 | Freeman et al. | 704/233 |
| 5,963,901 | A * | 10/1999 | Vahatalo et al. | 704/233 |
| 5,991,718 | A * | 11/1999 | Malah | 704/233 |
| 6,023,674 | A * | 2/2000 | Mekuria | 704/233 |
| 6,453,291 | B1 * | 9/2002 | Ashley | 704/233 |
| 6,615,170 | B1 * | 9/2003 | Liu et al. | 704/233 |
| 6,618,701 | B2 * | 9/2003 | Piket et al. | 704/233 |
| 7,171,357 | B2 * | 1/2007 | Boland | 704/231 |
| 7,535,859 | B2 * | 5/2009 | Brox | 370/290 |
| 7,881,927 | B1 * | 2/2011 | Reuss | 704/226 |
| 2004/0102967 | A1 * | 5/2004 | Furuta et al. | 704/226 |
| 2005/0108004 | A1 * | 5/2005 | Otani et al. | 704/205 |
| 2005/0222842 | A1 * | 10/2005 | Zakarauskas | 704/233 |

OTHER PUBLICATIONS

"Adaptive Multi-Rate (AMR) speech codec;—Voice Activity Detector (VAD)", 3GPP TS 26.094 V6.0.0, [online], http://www.3gpp.org. publishing year: 2004.*

(Continued)

*Primary Examiner* — Jialong He

(57) ABSTRACT

Embodiments of the present invention relate to a voice detector receiving an input signal that is divided into sub-signals that represent a frequency sub-band. The voice detector calculates, for each sub-band, a signal-to-noise (SNR) value based on a corresponding sub-signal for each sub-band and a background signal for each sub-band. The voice detector also calculates a power SNR value for each sub-band, where at least one of the power SNR values is calculated based on a non-linear function. The voice detector forms a single value based on the calculated power SNR values and compares the single value and a given threshold value to make a voice activity decision presented on an output port.

25 Claims, 5 Drawing Sheets

OTHER PUBLICATIONS

Davis, A. et al, "A Low Complexity Statistical Voice Activity Detector with Performance Comparisons to ITU-T / ETSI Voice Activity Detectors", Proceedings of the 2003 Joint Conference of the Fourth International Conference on Information, Communications and Signal Processing, 2003 and the Fourth Pacific Rim Conference on Multimedia, vol. 1, Dec. 15-18, 2003, p. 119-123.

Li Ye et al: "Voice Activity Detection in Non-stationary Noise", Computational Engineering in Systems Applications, IMACS Multiconference on, IEEE, PI, Oct. 1, 2006 (2006-18-81), XP831121496, ISBN: 978-7-382-13922-5.

Davis Aet Al: A multi-decision sub-band voice activity detector, 14th European Signal Processing Conference (EUSIPCO 2006) Florence, Italy, Sep. 4-8, 2006, XP002559305, Retrieved from the Internet: URL:http://www.eurasip.org/proceedings/eusipco/eusipco2886/papers/1568981 496.pdf [retrieved on Dec. 12, 2811].

Andreas Ekeroth: "Improvements of the voice activity detector in AMR-WB", Lulea University of Technology, Nov. 21, 2007, XP002665632, ISSN: 1402-1617 Retrieved from the Internet: URL:http://epubl.ltu.se/1402-1617/2007/262 /LTU-EX-07262-SE.pdf [retrieved on Dec. 12, 2011].

* cited by examiner

SYSTEM AND METHOD FOR AN IMPROVED VOICE DETECTOR

This application claims the benefit of U.S. Provisional Application No. 60/743,276, filed Feb. 10, 2006, the disclosure of which is fully incorporated herein by reference.

TECHNICAL FIELD

The present invention relates to a voice detector, a voice activity detector (VAD), and a method for selectively suppressing sub-bands in a voice detector.

BACKGROUND

An important part to reduce bit rate for high performance speech encoders is the use of comfort noise instead of silence or lower bit rate for backgrounds. The key function that makes this possible is a voice activity detector (VAD), which enables the separation between speech and background noise.

Several types of voice activity detectors have been proposed and in TS 26.094, see reference [1], a VAD (herein named AMR VAD1) is disclosed and variations are disclosed in reference [3]. The core features of the AMR VAD1 are:

- summing of sub-band Signal-to-Noise-Ratio (SNR) detector,
- Threshold adaptation based on signal level,
- background estimate adaptation based on previous decisions, and
- deadlock recovery analysis for step increases in noise level.

A drawback with the AMR VAD1 is that it is over-sensitive for some types of non-stationary background noise.

Another VAD (herein named EVRC VAD) is disclosed in C.S0014-A, see reference [2], as EVRC RDA and reference [4]. The main technologies used are:

- split band analysis, wherein worst case band is used for rate selection in a variable rate speech codec.
- adaptive noise hangover addition principle is used to reduce primary detector mistakes. Noise hangover adaptation is disclosed in reference [5], by Hong et al.

A drawback with the split band EVRC VAD is that it occasionally makes bad decisions and shows too low frequency sensitivity.

Voice activity detection is disclosed by Freeman, see reference [6] wherein a VAD with independent noise spectrum is disclosed, and Barret, see reference [7], disclosed a tone detector mechanism that does not mistakenly characterize low frequency car noise for signalling tones. A drawback with solutions based on Freeman/Barret occasionally shows too low sensitivity (e.g. for background music).

SUMMARY

An object of the invention is to provide a voice detector and a voice activity detector that is more sensitive to voice activity without experience the drawbacks of the prior art devices.

This object is achieved by a voice detector, and a voice activity detector using a voice detector where an input signal, divided into sub-signals representing n different frequency sub-bands, is used to calculate a signal-to-noise-ratio (SNR) for each sub-band. A SNR value in the power domain for each sub-band is calculated, and at least one of the power SNR values is calculated using a non-linear function. A single value is formed based on the power SNR values and the single value is compared to a given threshold value to generate a voice activity decision on an output port of the voice detector. By introducing the non-linear function for one or more sub-bands, the importance of sub-bands which are likely to introduce decision noise into the actual decision metric is selectively reduced by the non-linear function introduced after the SNR calculation.

Another object of the invention is to provide a method that provides a voice detector that is more sensitive to voice activity without experience the drawbacks of the prior art devices.

This object is achieved by a method of selectively reducing the importance of sub-bands adaptively, for a SNR summing sub-band voice detector where an input signal to the voice detector is divided into n different frequency sub-bands. The SNR summing is based on a non-linear weighting applied to signals representing at least one sub-band before SNR summing is performed.

An advantage with the present invention is that the voice quality is maintained, or even improved under certain conditions, compared to prior art solutions.

Another advantage is that the invention reduces the average rate for non-stationary noise conditions, such as babble conditions compared to prior art solutions.

DETAILED DESCRIPTION

Figure 1:
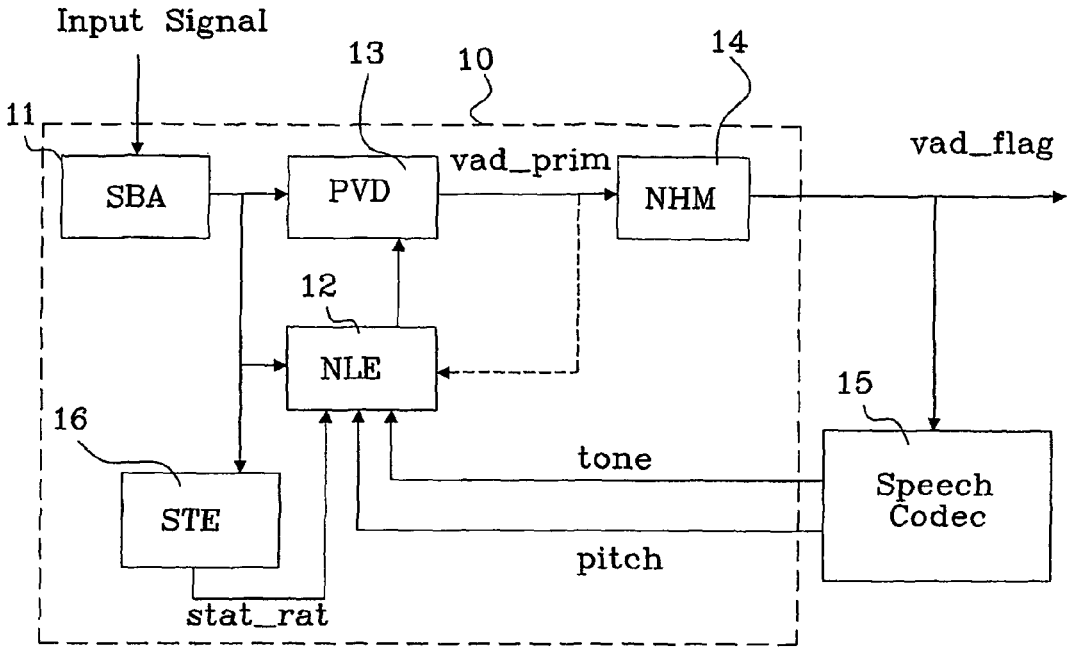
Fig. 1 (Prior Art)
FIG. 1 shows a prior art solution for a VAD.
Figure 2:
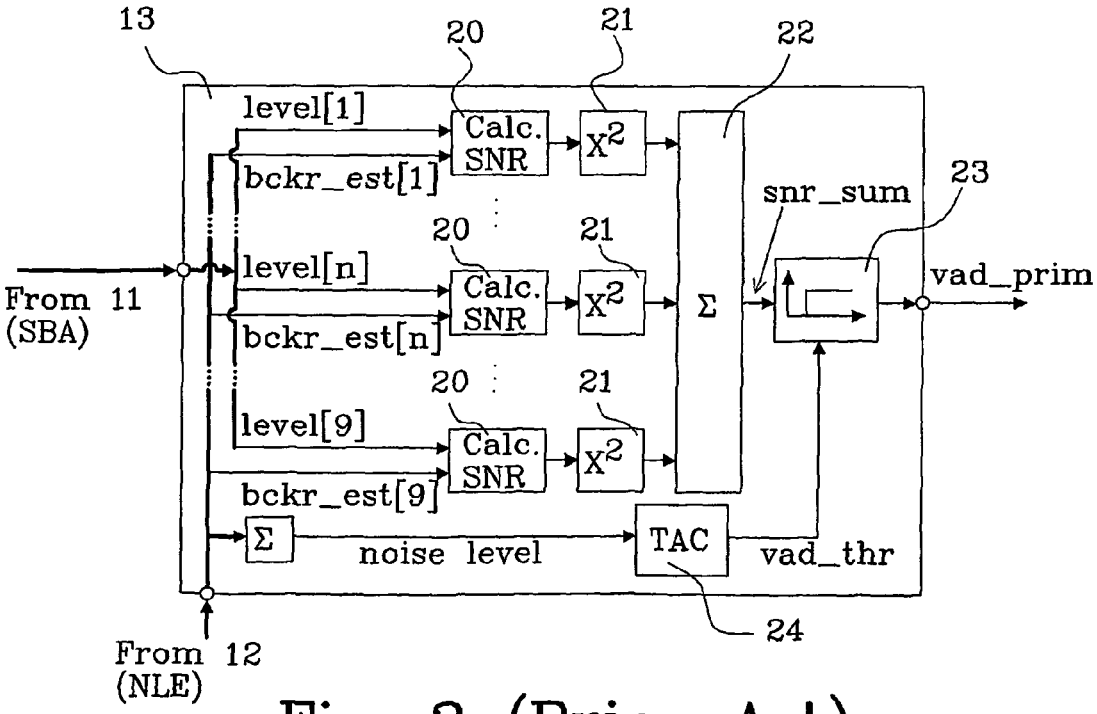
Fig. 2 (Prior Art)
FIG. 2 shows a detailed description of a voice detector used in the VAD described in connection with FIG. 1.

FIG. 1 shows a prior art Voice activity detector VAD 10 similar to the VAD disclosed in reference [1] named AMR VAD1, and FIG. 2 shows a detailed description of a primary voice detector used.

The VAD 10 divides the incoming signal "Input Signal" into frames of data samples. These frames of data samples are divided into "n" different frequency sub-bands by a sub-band analyzer (SBA) 11 which also calculates the corresponding input level "level[n]" for each sub-band. These levels are then used to estimate the background noise level "bckr_est[n]" in a noise level estimator (NLE) 12 for each sub-band by low pass filtering the level estimates for non-voiced frames. Thus, the NLE generates an estimated noise condition, or a background signal condition, e.g. music, used in a primary voice detector (PVD). The PVD 13 uses level information "level [n]" and estimated background noise level "bckr_est[n]" for each sub-band "n" to form a decision "vad_prim" on whether the current data frame contains voice data or not. The "vad_prim" decision is used in the NLE 12 to determine non-voiced frames.

The basic operation of the PVD 13, which is described in more detail in connection with FIG. 2, is to monitor changes in sub-band signal-to-noise-ratios (SNRs), and large enough changes are considered to be speech. This is obtained by calculating a signal-to-noise-ratio snr[n] in each sub-band using a "Calc. SNR" function in block 20:

$$snr[n] = \frac{\text{level}[n]}{\text{bckr_est}[n]} \tag{1}$$

The calculated SNR value is converted to power by taking the square of the calculated SNR value for each sub-band, which is calculated in block 21, and a combined SNR value snr_sum based on all the sub-bands is formed. The basis for the combined SNR value is the average value of all sub-band power SNR formed by the summation block 22 in FIG. 2.

$$\text{snr_sum} = \frac{1}{k}\sum_{n=1}^{k}(snr[n])^2, \tag{2}$$

where k is the number of sub-bands, for instance 9 sub-bands as illustrated in FIG. 2.

The primary voice activity decision "vad_prim" from the PVD 13 may then be formed by comparing the calculated "snr_sum" with a threshold value "vad_thr" in block 23. The threshold value "vad_thr" is obtained from a threshold adaptation circuit (TAC) 24, as shown in FIG. 2. The threshold value "vad_thr" is adjusted according to the background noise level, obtained by summing all sub-band background noise levels from the NLE 12, to increase the sensitivity (lower the threshold), and avoid missing frames containing voice data, if the background noise level is high.

The input levels calculated in the SBA 11 is also provided to a stationarity estimator (STE) 16 which provide information "stat_rat" to the NLE 12 which information indicates the long term stability of the background noise. A noise hangover module (NHM) 14 may also be provided in the VAD 10, wherein the NHM 14 is used to extend the number of frames that the PVD has detected as containing speech. The result is a modified voice activity decision "vad_flag" that is used in the speech codec system, as described in connection with FIG. 8. The "vad_flag" decision is provided to the speech codec 15 to indicate that the input signal contains speech, and the speech codec 15 provide signals "tone" and "pitch" to the NLE 12. The "vad-prim" decision may also be fed back to the NLE 12. The function blocks denoted SBA 11, NLE 12, NHM 14, speech codec 15 and STE 16 are well known to a skilled person in the art and is therefore not described in more detail.

A drawback with the described prior art PVD is that it may indicate voice activity for non-stationary background noise, such as babble background noise. An aim with the present invention is to modify the prior art PVD to reduce the drawback.

Figure 3:
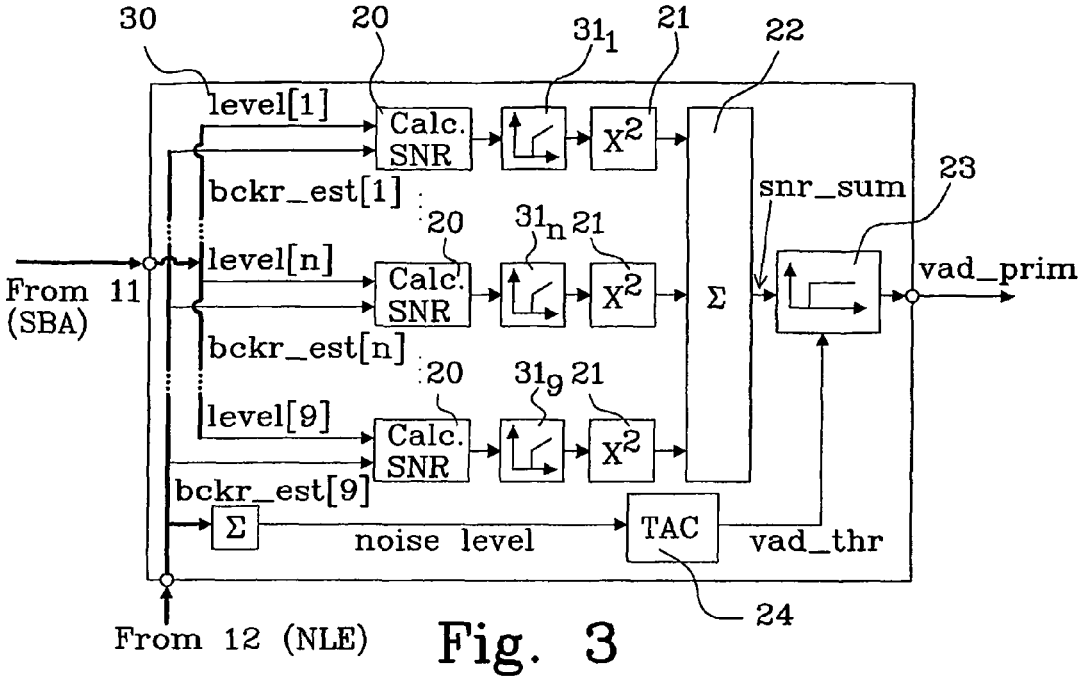
FIG. 3 shows a first embodiment of a voice detector according to the present invention.

FIG. 3 shows a first embodiment of a non-linear primary voice detector NL PVD 30, which includes the same function blocks as described in connection with FIG. 2 and a function block 31 for each sub-band "n". The function block 31 provides a non-linear weighting of the calculated SNR value from function block 20 which is the modification that reduces the problem with prior art. For this embodiment the non-linear function is implemented to produce the resulting snr_sum of the SNR summing by:

$$\text{snr_sum} = \frac{1}{k}\sum_{n=1}^{k}\begin{cases} 0 & \text{if } snr[n] < \text{sign_thresh} \\ (snr[n])^2 & \text{otherwise} \end{cases}, \tag{3}$$

wherein "k" is the number of sub-bands (e.g. k=9), "snr[n]" is signal-to-noise-ratio for sub-band "n", and "sign_tresh" is significance threshold value for the non-linear function.

The non-linear function is to set the SNR value for every calculated SNR value lower than "sign_thresh" to zero (0) and keep it unchanged for other SNR values. The significance threshold "sign_tresh" is preferably set to higher than one (sign_thresh>1), and more preferably to two or higher (sign_thresh≧2). The SNR value is squared to convert it into the power domain, as is obvious for a skilled person in the art. A SNR value of one or higher will result in a corresponding power SNR value of one or higher. However, there are other possibilities with regard to the implementation of the non-linear function in function block 31 when calculating snr_sum from the SNR summing, such as:

$$\text{snr_sum} = \frac{1}{k}\sum_{n=1}^{k}\begin{cases} (\text{sign_floor})^2 & \text{if sign_floor} < snr[n] < \text{sign_thresh} \\ (snr[n])^2 & \text{otherwise} \end{cases}, \tag{4}$$

wherein "k" is the number of sub-bands (e.g. k=9), "sign_floor" is a default value, "snr[n]" is signal-to-noise-ratio for sub-band "n", and "sign_tresh" is significance threshold value for the non-linear function.

The significance threshold "sign_tresh" is preferably set as discussed above, i.e. higher than one (sign_thresh>1), and more preferably to two or higher (sign_thresh≧2). The default value "sign_floor" is preferably less than one (sign_floor<1), and more preferably less than or equal to zero point five (sign_floor≦0.5).

Figure 4:
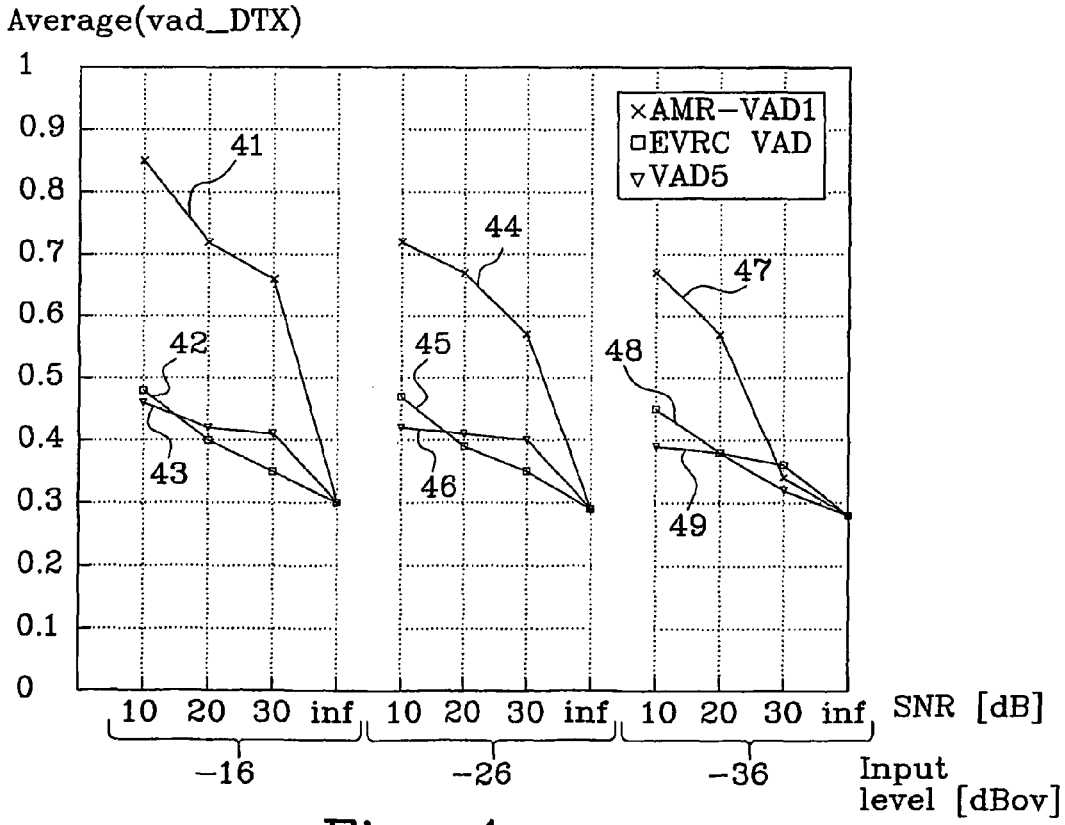
FIG. 4 shows a graph illustrating performance in voice activity for different VADs.

The improvement in performance in voice activity for speech with background babble noise is illustrated in FIG. 4, which shows the performance of different VADs. The graph presents the average value of the voice activity decision "Average(vad_DTX)" by the DTX hangover module, further described in FIG. 8, for different VADs as a function of three input levels in dBov and different SNR values in dB. dBov stands for "dB overload". A dBov level of 0 means the system is just at the threshold of overload. A digital 16 bit sample has a maximum of +32767, which corresponds to 0 dB. −26 dB means that the maximum sample size is 26 dB below the maximum.

The shown VADs are:

VAD 1: marked with a cross indicated by 41 for input level −16 dBov, 44 for input level −26 dBov, and 47 for input level −36 dBov.

EVRC VAD: marked with a square indicated by 42 for input level −16 dBov, 45 for input level −26 dBov, and 48 for input level −36 dBov.

VAD5 (which is a VAD comprising a primary voice detector 30 according to the invention): marked with a triangle indicated by 43 for input level −16 dBov, 46 for input level −26 dBov, and 49 for input level −36 dBov.

It should be pointed out that average activity "Average (vad_dtx)" for VAD5 is significantly lower compared to VAD 1 at all input levels with a SNR value below infinity, and "Average(vad_DTX)" for VAD5 is lower compared to EVRC VAD for all input levels with a SNR value of 10 dB. Further-more, VAD5 and EVRC VAD show equally good average activity and are comparable for other SNR values.

It should be mentioned that the significance threshold for the different sub-bands may be identical, or may be different, as illustrated below:

$$\text{snr_sum} = \frac{1}{k}\sum_{n=1}^{k}\begin{cases}(\text{sign_floor}[n])^2 & \text{if sign_floor}[n] < snr[n] < \text{sign_thresh}[n] \\ (snr[n])^2 & \text{otherwise}\end{cases}, \quad (5)$$

wherein "k" is the number of sub-bands (e.g. k=9), "sign_floor[n]" is a default value for each sub-band "n", "snr[n]" is signal-to-noise-ratio for sub-band "n", and "sign_tresh[n]" is significance threshold value for the non-linear function in each sub-band "n".

The use of different significance thresholds in different sub-bands will achieve a frequency optimized performance, for certain types of background noises. This means that the significance threshold could be set to 1.5 for the non-linear function in block $\mathbf{31}_1$ to $\mathbf{31}_5$ and to 2.0 in function block $\mathbf{31}_6$-$\mathbf{31}_9$ without departing from the inventive concept.

Figure 5:
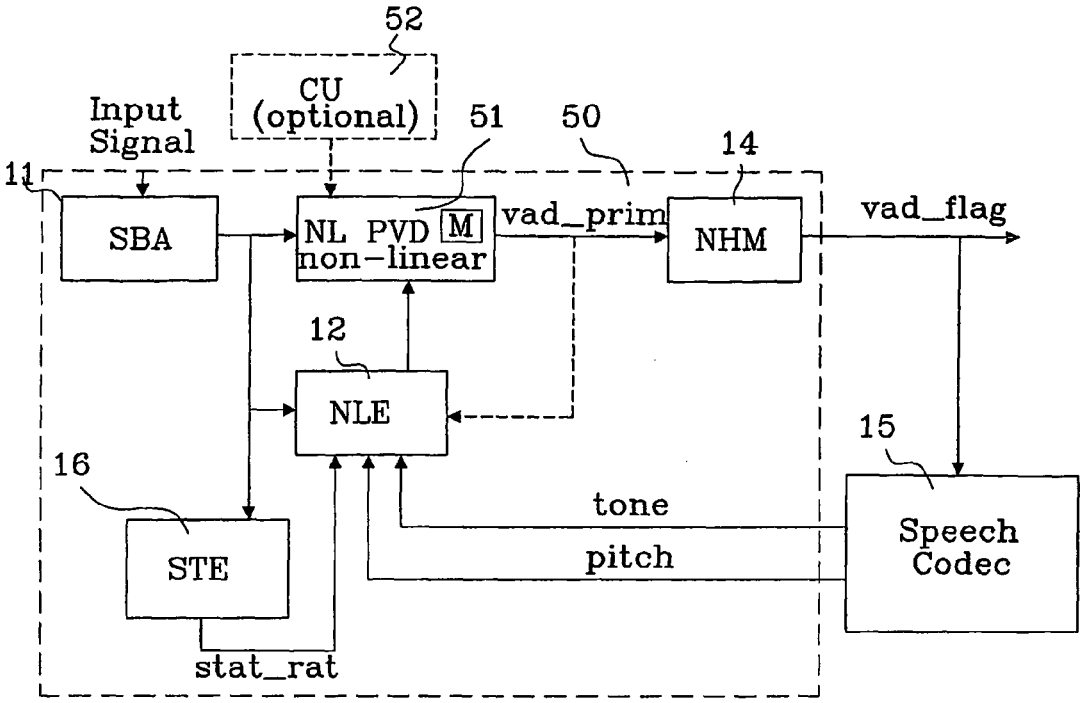
FIG. 5 shows first embodiment of a VAD according to the present invention.

In FIG. 5, a first embodiment of a VAD 50 according to the invention is described having the same function blocks as the prior art VAD described in connection with FIG. 1, except that a non-linear primary voice detector NL PVD 51, having a non-linear function block as described in connection with FIG. 3, is used instead of the prior art PVD. An optional control unit CU 52 may be connected to the VAD 50 to make adjustments to the significance threshold value "sign_tresh" and the default value "sign_floor" (if possible) for each sub-band during operation. The significance thresholds are fixed, but may be changed (updated) through CU 52.

In FIG. 5 the noise level for each sub-band is estimated based on the tone and pitch signals from the speech codec 15, the previous vad_prim decisions stored in a memory register accessible to the NLE 12 and the level stationarity value stat_rat obtained from the STE 16. The detailed configuration of the sub-band noise level adaptation is described in TS 26.094, reference [1]. The operation of the non-linear primary voice detector NL PVD is described above.

The earlier embodiments show how the non-linear primary voice detector can be used to improve the functionality so that false active decisions are reduced. However, for certain stable and stationary background noise conditions, such as car noise and white noise; there is a trade-off when setting the significance thresholds. To resolve this issue, the significance threshold can be made adaptive based on an independent longer term analysis of the background noise condition.

For conditions with assumed strong sub-band energy variation, a relaxed significance threshold may be employed, and for conditions with assumed low sub-band energy variation, a more stringent threshold may be used. The adaptation of the significance threshold is preferably designed so that active voice parts are not used in the estimation of the background noise condition.

Figure 6:
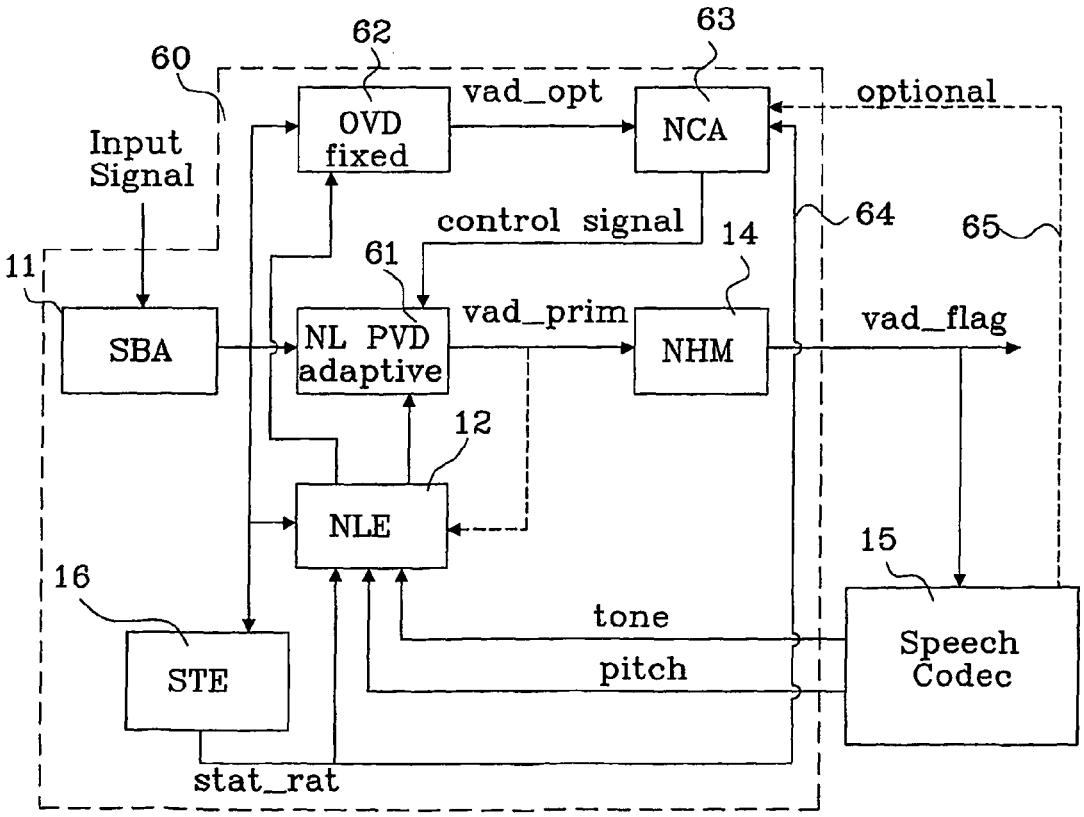
FIG. 6 shows a second embodiment of a VAD according to the present invention.

FIG. 6 shows a second embodiment of a VAD 60 according to the invention provided with a non-linear primary voice detector NL PVD 61 which significance threshold value for each sub-band in the non-linear function block may be adaptively adjusted. An optimistic voice detector OVD 62, with a fixed optimistic significance threshold setting, is continuously run parallel with the NL PVD 61 to produce an optimistic voice activity decision "vad_opt". The significance threshold of the NL PVD is adapted using background noise type information which is analyzed during non-active speech periods indicated by "vad_opt" in a noise condition adaptor NCA 63. Based on the two additional modules, i.e. OVD 62 and NCA 63, the significance threshold sign_tresh in the NL PVD 61 is adjusted by a control signal from the NCA 63. The optimistic voice detector OVD 62 is preferably a copy of the NL PVD 61 with an optimistic (or aggressive) setting of a significance threshold value, preferably a fixed value SF. A preferred value for SF is 2.0.

The background noise type information, upon which the NBA 63 generates the control signal, is preferably the stat_rat signal generated in STE 16 as indicated by the solid line 64, but the control signal may be based on other parameters characterizing the noise, especially parameters available in the TS 26.094 VAD 1 and from the speech codec analysis as indicated by the dashed line 65, e.g. high pass filtered pitch correlation value, tone flag, or speech codec pitch_gain parameter variation.

In the preferred embodiment the stat_rat value from STE 16 is used as the background noise type information upon which the control signal is based during non-active speech periods as indicated by "vad_opt". A modification of the original algorithm described in TS 26.094 is that the calculation of the stationarity estimation value "stat_rat" is performed continuously for every VAD decision frame. In 3GPP TS 26.094, the calculation of "stat_rat" is explained in section "3.3.5.2 Background noise estimation".

Stationarity (stat_rat) is estimated using the following equation:

$$\text{stat_rat} = \sum_{n=1}^{9}\frac{\text{MAX}(\text{STAT_THR_LEVEL}, \text{MAX}(\text{ave_level}_m[n], level_m[n]))}{\text{MAX}(\text{STAT_THR_LEVEL}, \text{MIN}(\text{ave_level}_m[n], level_m[n]))}$$

where $\text{level}_m$ is the vector of current sub-band amplitude levels and $\text{ave_level}_m$ is an estimation of the average of past sub-band levels. STAT_THR_LEVEL is set to an appropriate value, e.g. 184 (TS 26.094 VAD1 scaling/precision.)

A high "stat_rat" value indicates existence of large intra band level variations, a low "stat_rat" value indicates smaller intra band level variations.

The history of vad_opt decisions is stored in a memory register which is accessible for the NCA during operation.

The added NCA 63 uses the "stat_rat" value to adjust the NL PVD 61 as follows:

When vad_opt has indicated speech inactivity for at least 80 ms,

- If "stat_rat" value is higher than a threshold STAT_THR (indicating high variablility) then generate a control signal that move "sign_tresh" in equation (3)-(5) value towards the value 2.0 with step size of 0.02.
- If "stat_rat" value is lower than a threshold STAT_THR (indicating low variablility) then generate a control signal that move "sign_tresh" in equation (3)-(5) value towards the value 0.125 with step size of 0.01.

If vad_opt indicated any speech activity within the last 80 ms, then do not generate a control signal to adapt "sign_tresh" value in equation (3)-(5).

The result of the adaptive solution described above is that the significance threshold(s) are continuously adjusted during assumed inactivity periods, and the primary voice detector NL-PVD is made more (or less) sensitive through modification of the significance threshold(s) in dependency of the sub-band energy analysis.

Figure 7:
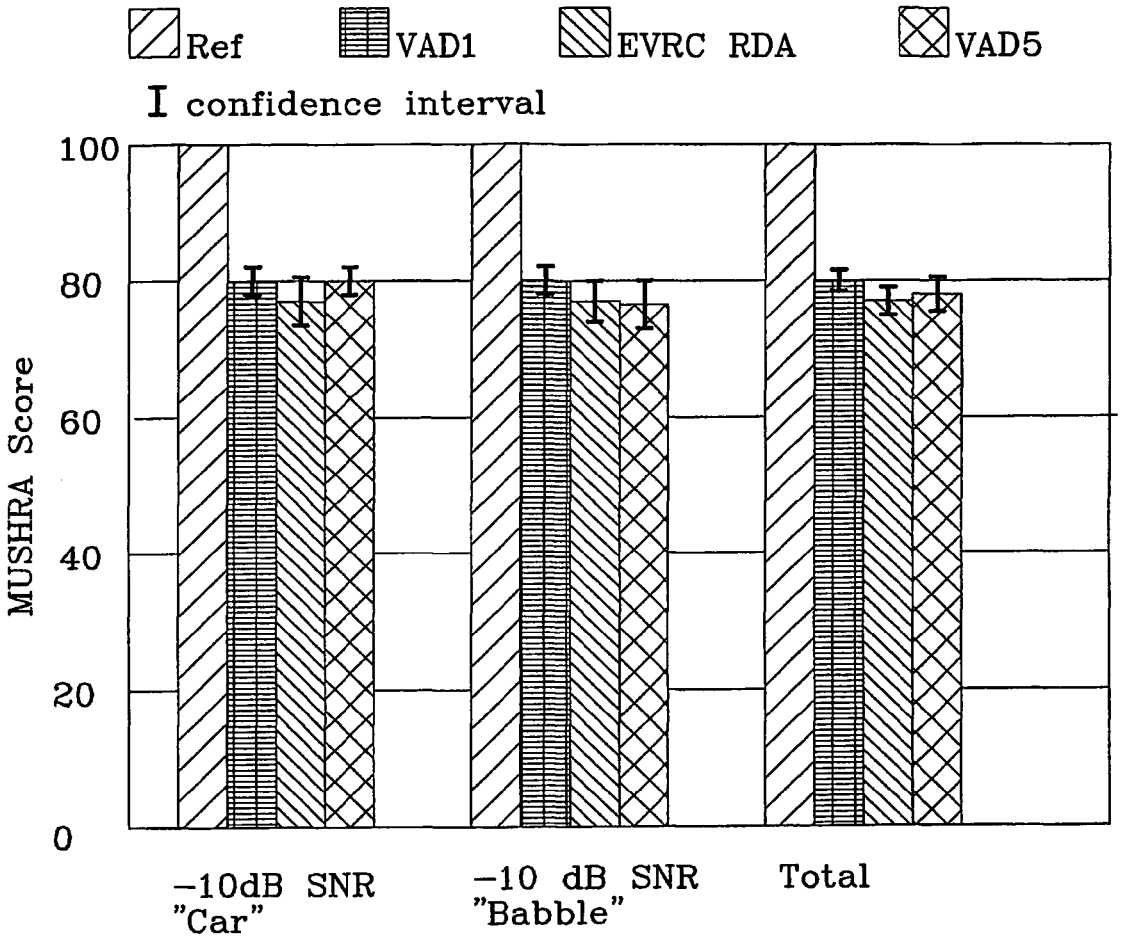
FIG. 7 shows a graph illustrating subjective results obtained by a Mushra expert listening test for different VADs.

FIG. 7 shows subjective results obtained from Mushra expert listening tests of critical material, consisting of speech at −26 dBov in combination with different background noises, such as car, garage, babble, mall, and street (all with a 10 dB SNR). For the Mushra test, speech samples from different encoders are ordered with regard to quality. The test used an AMR MR122 mode as a high quality reference denoted "Ref". The compared VAD functions were encoded using AMR MR59 mode and consisted of VAD1, EVRC VAD (used without noise suppression), and the disclosed VAD with fixed significance thresholds 2.0 and significance floor 0.5 denoted VAD5.

The 95% confidence intervals for the different VADs are indicated in FIG. 7 and from a listening point of view, there are no essential difference between the different VADs although the average activity for the present invention (VAD5) is considerable lower compared to VAD1, see FIG. 4.

Figure 8:
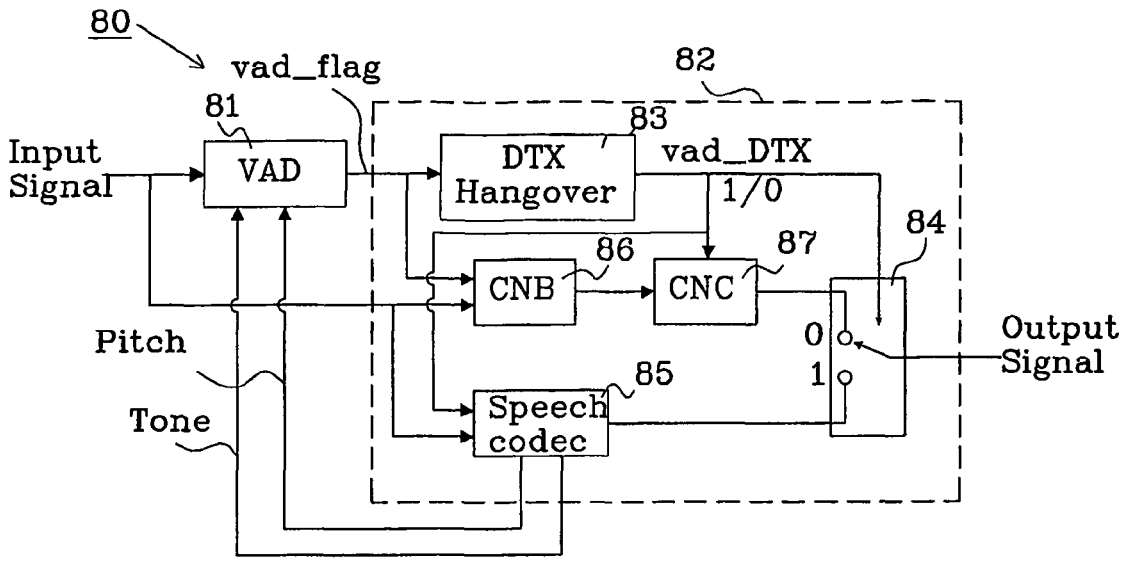
FIG. 8 shows a speech coder including a VAD according to the invention.

FIG. 8 shows a complete encoding system 80 including a voice activity detector VAD 81, preferably designed according to the invention, and a speech coder 82 including Discontinuous Transmission/Comfort Noise (DTX/CN). FIG. 8 shows a simplified speech coder 82, a detailed description can be found in reference [8] and [9]. The VAD 81 receives an input signal and generates a decision "vad_flag". The speech coder 82 comprises a DTX Hangover module 83, which may add seven extra frames to the "vad_flag" received from the VAD 81, for more details see reference [9]. If "vad_DTX"="1" then voice is detected, and if "vad_DTX"="0" then no voice is detected. The "vad_DTX" decision controls a switch 84, which is set in position 0 if "vad_DTX" is "0" and in position 1 if "vad_DTX" is "1".

"vad_DTX" is in this example also forwarded to a speech codec 85, connected to position 1 in the switch 84, the speech codec 85 use "vad_DTX" together with the input signal to generate "tone" and "pitch" to the VAD 81 as discussed above. It is also possible to forward "vad_flag" from the VAD 81 instead of the "vad_DTX". The "vad_flag" is forwarded to a comfort noise buffer (CNB) 86, which keeps track of the latest seven frames in the input signal. This information is forwarded to a comfort noise coder 87 (CNC), which also receive the "vad_DTX" to generate comfort noise during the non-voiced frames, for more details see reference [8]. The CNC is connected to position 0 in the switch 84.

Figure 9:
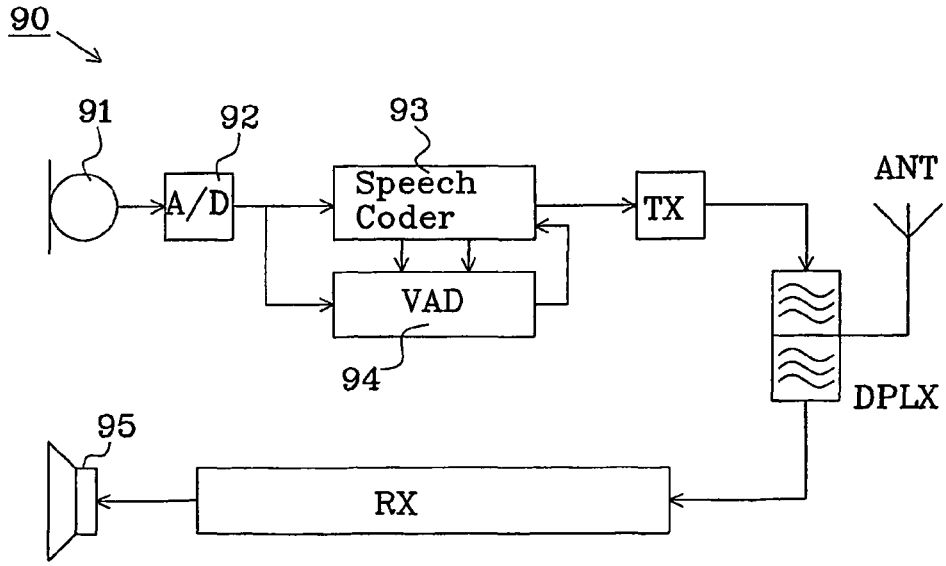
FIG. 9 shows a terminal including a VAD according to the invention.

FIG. 9 shows a user terminal 90 according to the invention. The terminal comprises a microphone 91 connected to an A/D device 92 to convert the analogue signal to a digital signal. The digital signal is fed to a speech coder 93 and VAD 94, as described in connection with FIG. 8. The signal from the speech coder is forwarded to an antenna ANT, via a transmitter TX and a duplex filter DPLX, and transmitted there from. A signal received in the antenna ANT is forwarded to a reception branch RX, via the duplex filter DPLX. The known operations of the reception branch RX are carried out for speech received at reception, and it is repeated through a speaker 95.

The input signal to the voice detector described above has been divided into sub-signals, each representing a frequency sub-band. The sub-signal may be a calculated input level for a sub-band, but it is also conceivable to create a sub-signal based on the calculated input level, e.g. by converting the input level to the power domain by multiplying the input level with it self before it is fed to the voice detector. Sub-signals representing the frequency sub-bands bands may also be generated by auto correlation, as described in reference [2] and [4], wherein the sub-signals are expressed in the power domain without any conversion being necessary. The same applies to the background sub-signals received in the voice detector.

Statements regarding the invention;

The voice detector wherein the estimated noise, or background signal condition, is based on non-active voice parts of the input signal.

The voice detector wherein the voice detector is configured to replace each SNR value (snr[n]) being less than the sub-band specific significance threshold value (sign_thresh) with a default value in the non-linear function. Wherein said default value is zero (0) or the default value is less than the SNR value for each sub-band. The default value could also be specified as less than one (sign_floor<1), preferably less than or equal to zero point five (sign_floor≦0.5).

The voice activity detector wherein the primary voice detector (30; 51; 61) is provided with a memory in which previous primary voice activity decisions (vad_prim) are stored; and the estimated background noise calculated in the noise level estimator (12) for each sub-band is further based on the stored previous primary voice activity decision (vad_prim).

The voice activity detector further comprising:

means (62, 63) to produce a control signal based on parameters characterizing noise in the input signal, said control signal is used in the primary voice detector (61) to adaptively adjust a sub-band specific significance threshold (sign_thresh) in the non-linear function.

The voice activity detector further comprising a stationarity estimator (16) configured to produce a stationarity value (stat_rat) based on the calculated input level (level [n]) for each sub-band, wherein said control signal is based on the stationarity value (stat_rat).

The voice activity detector wherein said means to produce a control signal comprises a secondary voice detector (62), as defined in any of claims 1-20, configured to produce a secondary voice activity decision (vad_opt), said control signal (sig_thresh) is further based on the secondary voice activity decision (vad_opt).

The voice activity detector wherein the secondary voice detector (62) use a non-linear function having a fixed significance threshold (SF) for all sub-bands.

ABBREVIATIONS

AMR Adaptive Multi Rate
ANT Antenna
CNB Comfort Noise Buffer
CNC Comfort Noise Coder
DTX Discontinuous Transmission
DPLX Duplex Filter
EVRC Enhanced Variable Rate (IS-127)
NCA Noise Condition Adaptor
NHM Noise Hangover Module
NLE Noise Level Estimator
NL PVD Non-Linear Primary Voice Detector
OVD Optimistic Voice Detector
PVD Primary Voice Detector
RX Reception branch
SBA Sub-Band Analyzer
SNR Signal to Noise Ratio
STE Stationarity Estimator
TAC Threshold Adaptation Circuit
TX Transmitter
VAD Voice Activity Detector

REFERENCES

[1] "Adaptive Multi-Rate (AMR) speech codec; Voice Activity Detector (VAD)" 3GPP TS 26.094 V6.0.0 (2004-12)

[2] "Enhanced Variable Rate Codec, Speech Service Option 3 for Wideband Spread Spectrum Digital Systems", 3GPP2, C.S0014-A v1.0, 2004-05

[3] U.S. Pat. No. 5,963,901 A1, by Vahatalo, with the title "Method and device for voice activity detection, and a communication device", assigned to Nokia, Dec. 10, 1996.

[4] U.S. Pat. No. 5,742,734 A1, by De Jaco, with the title "Encoding rate selection in a variable rate vocoder", assigned to Qualcomm, Aug. 10, 1994

[5] U.S. Pat. No. 5,410,632 A1, by Hong, with the title "Variable hangover time in a voice activity detector", assigned to Motorola, Dec. 23, 1991

[6] U.S. Pat. No. 5,276,765 A1, by Freeman, with the title "Voice Activity Detection", Mar. 10, 1989

[7] U.S. Pat. No. 5,749,067 A1, by Berrett, with the title "Voice activity detector", Mar. 8, 1996

[8] "Adaptive Multi-Rate (AMR) speech codec; Comfort Noise AMR Speech Traffic Channels" 3GPP TS 26.094 V6.0.0 (2004-12)

[9] "Adaptive Multi-Rate (AMR) speech codec; Source Control Rate Operation" 3GPP TS 26.093 V6.1.0 (2006-06)

The invention claimed is:

1. A voice detector being responsive to an input signal being divided into sub-signals each representing a frequency sub-band (n), said voice detector comprises:

a first input port configured to receive said sub-signals, a second input port configured to receive a background sub-signal based on said sub-signals, and means to calculate, for each sub-band, an SNR value (snr[n]) based on the corresponding sub-signal, and the background sub-signal, wherein said voice detector further comprises:

means to calculate a power SNR value for each sub-band, wherein at least one of said power SNR values is calculated based on a non-linear function and said power SNR value has a value of $(snr[n])^2$, means to form a single value (snr_sum) based on the calculated power SNR values, means to compare said single value (snr_sum) and a given threshold value (vad_thr) to make a voice activity decision (vad_prim) presented on an output port, and wherein the voice detector is configured to apply the non-linear function to the SNR value before calculating the power SNR value based on the non-linear function, use a sub-band specific significance threshold value (sign_thresh) in the non-linear function to selectively suppress sub-bands, adaptively adjust the sub-band significance threshold value based on estimated noise, or background signal condition, and replace each SNR value (snr[n]) being less than the sub-band specific significance threshold value (sign_thresh) with a default value in the non-linear function.

2. The voice detector according to claim 1, wherein each of said power SNR values is calculated based on a non-linear function.

3. The voice detector according to claim 1, wherein the sub-band specific significance threshold value (sign_thresh) is different for at least two sub-bands.

4. The voice detector according to claim 1, wherein the sub-band specific significance threshold value (sign_thresh) is the same for all sub-bands.

5. The voice detector according to claim 1, wherein the sub-band specific significance threshold value has a value of higher than one (sign_thresh>1), preferably two or higher (sign_thresh≧2).

6. The voice detector according to claim 1, wherein the voice detector is configured to have a fixed sub-band specific significance threshold value.

7. The voice detector according to claim 1, wherein the estimated noise, or background signal condition, is based on non-active voice parts of the input signal.

8. The voice detector according to claim 1, wherein said default value is zero (0).

9. The voice detector according to claim 1, wherein said default value is less than the SNR value for each sub-band.

10. The voice detector according to claim 9, wherein the default value is less than one (sign_floor<1), preferably less than or equal to zero point five (sign_floor≦0).

11. The voice detector according to claim 1, wherein said background sub-signal for each sub-band is calculated based on previous primary voice activity decisions (vad_prim) calculated in the voice detector.

12. The voice detector according to claim 1, wherein the input signal contains nine frequency sub-bands.

13. The voice detector according to claim 1, wherein the means to calculate power SNR values for each sub-band further is based on a square function implemented in a converter.

14. The voice detector according to claim 1, wherein the means to form a single value (snr_sum) comprises a summation block, in which an average value of all sub-band power SNR is formed.

15. The voice detector according to claim 1, wherein the voice detector further comprises a threshold adaptation circuit that produces said given threshold value (vad_thr) in response to a signal (noise level) generated by summation of the background sub-signal for all sub-bands.

16. The voice detector according to claim 1, wherein each sub-signal is based on a calculated input level (level[n]) for each sub-band, and each background sub-signal is based on an estimated background noise level (bckr_est[n]) for each sub-band.

17. A voice activity detector used to determine if voice data is contained in an input signal, wherein said voice activity detector comprises the voice detector as defined in claim 1, wherein the voice detector is a primary voice detector.

18. The voice activity detector according to claim 17, further comprising:

a sub-band analyzer configured to divide said input signal into frames of data samples, and further divide the frames of data samples into frequency sub-bands, said sub-band analyzer further configured to calculate a corresponding input level (level[n]) for each sub-band, and a noise level estimator configured to generate an estimated background noise level (bckr_est[n]) for each sub-band based on the calculated input levels (level[n]).

19. The voice activity detector according to claim 18, wherein the primary voice detector is provided with a memory in which previous primary voice activity decisions (vad_prim) are stored; and the estimated background noise calculated in the noise level estimator for each sub-band is further based on the stored previous primary voice activity decision (vad_prim).

20. The voice activity detector according to claim 17, further comprising:

means to produce a control signal based on parameters characterizing noise in the input signal, said control signal is used in the primary voice detector to adaptively adjust a sub-band specific significance threshold (sign_thresh) in the non-linear function.

21. The voice activity detector according to claim 20, further comprising a stationarity estimator configured to produce a stationarity value (stat_rat) based on the calculated input level (level[n]) for each sub-band, wherein said control signal is based on the stationarity value (stat_rat).

22. The voice activity detector according to claim 20, wherein said means to produce a control signal comprises a secondary voice detector configured to produce a secondary voice activity decision (vad_opt), said control signal (sig_thresh) is further based on the secondary voice activity decision (vad_opt).

23. The voice activity detector according to claim 22, wherein the secondary voice detector use a non-linear function having a fixed significance threshold (SF) for all sub-bands.

24. A node in a telecommunication system comprising the voice activity detector as defined in claim 17.

25. The node according to claim 24, wherein the node is a terminal.

* * * * *

UNITED STATES PATENT AND TRADEMARK OFFICE

CERTIFICATE OF CORRECTION

PATENT NO. : 8,204,754 B2
APPLICATION NO. : 12/279042
DATED : June 19, 2012
INVENTOR(S) : Sehlstedt It is certified that error appears in the above-identified patent and that said Letters Patent is hereby corrected as shown below:

On Title Page 2, in Item (56), under "OTHER PUBLICATIONS", in Column 2, Line 1, delete "Davis Aet Al:" and insert -- Davis A. et al: --, therefor.

On Title Page 2, in Item (56), under "OTHER PUBLICATIONS", in Column 2, Line 5, delete "2811]." and insert -- 2011]. --, therefor.

In the Specifications

In Column 6, Line 52, delete "variablility)" and insert -- variability) --, therefor.

In Column 6, Line 56, delete "variablility)" and insert -- variability) --, therefor.

In Column 7, Line 65, delete "bands may" and insert -- may --, therefor.

Signed and Sealed this
First Day of October, 2013

Teresa Stanek Rea

Teresa Stanek Rea
*Deputy Director of the United States Patent and Trademark Office*